United States Patent [19]

Hogenboom et al.

[11] Patent Number: 5,035,111

[45] Date of Patent: Jul. 30, 1991

[54] COMBINATIONS OF POLYMER FILAMENTS OR YARNS HAVING A LOW COEFFICIENT OF FRICTION AND FILAMENTS OR YARNS HAVING A HIGH COEFFICIENT OF FRICTION, AND USE THEREOF

[75] Inventors: Eric H. M. Hogenboom; Peter Bruinink, both of Maastricht, Netherlands

[73] Assignee: Stamicarbon B.V., Geleen, Netherlands

[21] Appl. No.: 251,455

[22] Filed: Sep. 30, 1988

[30] Foreign Application Priority Data

Oct. 2, 1987 [DE] Fed. Rep. of Germany ..... 3733427

[51] Int. Cl.[5] ..... D02G 3/04; D02G 3/38; D01H 4/00

[52] U.S. Cl. ..... 57/224; 57/231; 57/236; 57/244; 57/256; 428/377

[58] Field of Search ..... 57/236, 231, 224, 244, 57/256; 428/377

[56] References Cited

U.S. PATENT DOCUMENTS

| | | | |
|---|---|---|---|
| 3,621,646 | 11/1971 | Bobcowicz et al. | 57/224 |
| 4,099,370 | 7/1978 | Uniastowski et al. | 57/224 |
| 4,403,012 | 9/1963 | Harpell et al. | 428/902 |
| 4,428,752 | 1/1984 | Goldenstein | 57/224 |
| 4,543,286 | 9/1985 | Harpell et al. | 428/293 |
| 4,681,792 | 7/1987 | Harpell et al. | 428/911 |
| 4,737,401 | 4/1988 | Harpell et al. | 428/298 |
| 4,737,402 | 4/1988 | Harpell et al. | 428/252 |
| 4,748,064 | 5/1988 | Harpell et al. | 428/911 |
| 4,801,491 | 1/1989 | Tanaka et al. | 428/259 |
| 4,820,568 | 4/1989 | Harpell et al. | 428/902 |
| 4,834,755 | 5/1989 | Silvestrini et al. | 623/13 |
| 4,840,826 | 6/1989 | Shirasaki et al. | 428/298 |
| 4,883,700 | 11/1989 | Harpell et al. | 428/911 |
| 4,967,548 | 11/1990 | Fangeat | 57/224 |

FOREIGN PATENT DOCUMENTS

| | | |
|---|---|---|
| 322979 | 7/1989 | European Pat. Off. . |
| 3004699 | 8/1980 | Fed. Rep. of Germany . |
| 3142507 | 6/1982 | Fed. Rep. of Germany . |
| 3346229 | 7/1985 | Fed. Rep. of Germany . |
| 2042414 | 9/1980 | United Kingdom . |
| 2051667 | 1/1981 | United Kingdom . |

OTHER PUBLICATIONS

*Belgian Patents Report* No. 42/69, 731,242.

*Primary Examiner*—James C. Cannon
*Attorney, Agent, or Firm*—Cushman, Darby & Cushman

[57] ABSTRACT

The invention relates to combinations of polymer filaments or yarns of high tensile strength, high modulus and low coefficients of friction and filaments or yarns of high coefficients of friction. Combinations of this type, which have been produced in particular by core spinning the filaments or yarns of low coefficient of friction with filaments or yarns of high coefficients of friction or by twisting the two filament or yarn components, are suitable in particular for producing bulletproof wovens, knits and nonwovens.

22 Claims, No Drawings

COMBINATIONS OF POLYMER FILAMENTS OR YARNS HAVING A LOW COEFFICIENT OF FRICTION AND FILAMENTS OR YARNS HAVING A HIGH COEFFICIENT OF FRICTION, AND USE THEREOF

The present invention relates to combinations of polymer filaments or yarns having low coefficients of friction with filaments or yarns having high coefficients of friction.

Filaments having a high tensile strength and a high modulus consist in general of polymers having high molecular weights and are highly drawn. The surface of such filaments is in general very smooth. Accordingly, the coefficients of friction of such filaments are low. Such filaments, or rather yarns, wovens, knits or nonwovens produced therefrom, are used for many purposes where the high tensile strength and the high modulus of these filaments are useful. For instance, such filaments would be useful for producing bulletproof woven or nonwoven materials. However, wovens or nonwovens produced from such filaments have the disadvantage that the smooth surface, and hence the low coefficient of friction, of the filaments forming the woven or nonwoven materials and the associated good gliding action make it relatively easy for an impacting bullet to move these filaments apart, so that despite the high tensile strengths and moduli of such plastics filaments, the bulletproof wovens and nonwovens produced therefrom are still not totally satisfactory.

To eliminate this disadvantage, such polymer filaments having low coefficients of friction and a high tensile strength and high moduli have been roughened mechanically and/or chemically or been provided with coatings to reduce the gliding action mentioned and to stop penetration by bullets due to the individual filaments being moved apart. Roughening reduces the tensile strength of the filaments to a substantial degree, so that the woven materials produced from roughened filaments are still not satisfactory, while the application of coatings is time-consuming and costly.

It is therefore an object of the present invention to make it possible, while retaining the high tensile strength and modulus values of polymer filaments having low coefficients of friction, nonetheless to produce woven, knits and nonwoven materials whose fiber or yarn components cannot be moved apart by impacting bullets on account of their low coefficients of friction (smooth surface) and the associated gliding action.

This object is achieved by the combination according to the invention of polymer filaments or yarns having a high tensile strength, high moduli and low coefficients of friction and filaments or yarns having high coefficients of friction.

According to the invention, polymer filaments having high tensile strengths and moduli and low coefficients of friction are therefore combined with filaments having high coefficients of friction, so that they, while retaining their tensile strength values and moduli, no longer have smooth surfaces and accordingly no low coefficients of friction and therefore are particularly suitable for producing bulletproof woven, knits or nonwoven materials.

It is not only possible to combine filaments having low coefficients of friction with those having high coefficients of friction, but also to modify, in the desired manner, types of yarn composed of filaments having low coefficients of friction by combination with either filaments or types of yarn having high coefficients of friction.

Advantageously, the filaments or types of yarn having low coefficients of friction are combined with the filaments or yarns having high coefficients of friction by core spinning the filaments having low coefficients of friction with filaments having high coefficients of friction or by twisting the two types of filament or yarn.

The filaments or yarns having low coefficients consist in particular of polyolefins, polyvinyl alcohols, polyamides or polyesters, but all filaments having low coefficients of friction and high tensile strengths and moduli, in particular of more than 2 GPa and 60 GPa respectively, may be useful.

In the combinations according to the invention, particularly suitable filaments having low coefficients of friction, and yarns produced therefrom, are those which have been produced by the gel process and subsequently highly drawn, in particular to draw ratios of more than 20, in particular more than 30.

The gel process, which is described for example in more detail in DE Offenlegungsschrift No. 3,724,434, comprises essentially dissolving the particular polymer which, to obtain high tensile strength and modulus values, is of high molecular weight in a solvent, molding the solution at a temperature above the dissolving temperature of the polymer into a filament, cooling the filament, for gelling, down to a temperature below the dissolving temperature, and then drawing the gel filament with solvent removal.

Preferably, the filaments or yarns having low coefficients of friction in the combinations according to the invention consist of polyethylenes, in particular linear polyethylenes, having an ultrahigh molecular weight of more than 600,000 g/mol (weight average of molecular weight). These polyethylenes may contain minor amounts, preferably not more than 5 mol %, of one or more other alkenes copolymerizable therewith, such as propylene, butylene, pentene, hexene, 4-methylpentene, octene etc. Preferably, the polyethylenes can have 1 to 10, in particular 2 to 6, methyl or ethyl groups per 1,000 carbon atoms. However, it is also possible to use other polyolefins, for example propylene homopolymers and copolymers; furthermore, the polyolefins used may also contain minor amounts of one or more other polymers, in particular alkene monopolymers. Filaments of this type can be produced for example by the processes described in GB-A-2,042,414 and -2,051,667.

The filaments or yarns having high coefficients of friction can comprise any desired natural or synthetic filaments or yarns which either as such already have a high coefficient of friction or have been provided with a high coefficient of friction by conventional mechanical and/or chemical roughening or by applying the coating. The roughening can be effected by means of a corona treatment. With these filaments or yarns it is immaterial that their tensile strength suffered due to the roughening treatment. Particularly suitable filaments or yarns having a high coefficient of friction are rubber filaments or yarns and also filaments or yarns made of cotton, elastomers, polyacrylates, polymethacrylates and polyurethanes.

Advantageously it is of course the case that the proportion of filaments or yarns having high coefficients of friction is kept low in relation to the proportion of filaments or yarns having a smooth surface but high tensile strength and modulus values and is in particular between 5 and 30% by weight based on the proportion of the filaments or yarns having a smooth surface.

If the combinations according to the invention consist of filaments or yarns having low coefficients of friction which have been produced by core spinning with filaments and/or yarns having high coefficients of friction, then the proportion of filaments or yarns having high coefficients of friction is preferably between 5 and 25% by weight, while the amount in the case of twisting ranges between 5 and 30% by weight, in particular between 10 and 20% by weight.

It is also advantageous to combine very thick filaments or yarns having low coefficients of friction and very thin filaments or yarns having high coefficients of friction (rough surface), to ensure very high tensile strength and modulus values for the wovens, knits and nonwovens produced from these filaments.

Experiments have proven that the structures according to the invention have better impact resistance and better energy absorbing properties.

We claim:

1. A filament or yarn having utility in production of bullet-proof articles comprising a first fiber consisting essentially of at least one of a polyolefin and a polyvinyl alcohol, core spun or twisted with a second fiber having a higher coefficient of friction than said first fiber and consisting essentially of at least one of cotton, an elastomer, a polyacrylate, a polymethacrylate, and a polyurethane, wherein said first fiber has a higher tensile strength and a higher modulus than said second fiber and, wherein the proportion of said second fiber is a minor amount by weight.

2. A filament or yarn according to claim 1, wherein the fibers have been produced by a gel process and have been highly drawn.

3. A filament or yarn according to claim 1, wherein the proportion of filaments or yarns having a high coefficient of friction is 5 to 30% by weight in relation to the proportion of filaments or yarns having a low coefficient of friction.

4. A filament or yarn according to claim 1, wherein the first fiber consists of polyethylenes having a weight average molecular weight of more than 600,000 g/mol.

5. A filament or yarn according to claim 4, wherein said polyethylene comprises linear polyethylene.

6. A filament or yarn according to claim 1, wherein said second fibers have a roughened surface.

7. A filament or yarn according to claim 6, wherein said roughening is effected by corona treatment.

8. A filament or yarn according to claim 1, wherein the proportion of filaments or yarns having a high coefficient of friction is 5 to 25% by weight in relation to the proportion of filaments or yarns having a low coefficient of friction.

9. A filament or yarn according to claim 1, wherein the proportion of filaments or yarns having a high coefficient of friction is 10 to 20% by weight in relation to the proportion of filaments or yarns having a low coefficient of friction.

10. A filament or yarn comprising a first fiber consisting essentially of at least one polyolefin, core spun or twisted with a second fiber having a higher coefficient of friction than said first fiber and consisting essentially of at least one of cotton, an elastomer, a polyacrylate, a polymethacrylate, and a polyurethane, wherein said first fiber is an ultrahigh weight average molecular weight gel-processed-highly-drawn fiber having a higher tensile strength and a higher modulus than said second fiber and, wherein the proportion of filaments or yarns having a high coefficient of friction is 5 to 30% by weight in relation to the proportion of filaments or yarns having a low coefficient of friction.

11. A filament or yarn according to claim 10, wherein the first fiber consists essentially of polyethylenes.

12. A filament or yarn according to claim 10, wherein said second fibers have a roughened surface.

13. A filament or yarn according to claim 10, wherein the first fiber consists essentially of polyethylenes, and said second fibers have a roughened surface.

14. A filament or yarn according to claim 10, wherein the proportion of filaments or yarns having a high coefficient of friction is 5 to 25% by weight in relation to the proportion of filaments or yarns having a low coefficient of friction.

15. A filament or yarn according to claim 14, wherein the first fiber consists essentially of polyethylenes, and said second fibers have a roughened surface.

16. A filament or yarn according to claim 10, wherein the proportion of filaments or yarns having a high coefficient of friction is 10 to 20% by weight in relation to the proportion of filaments or yarns having a low coefficient of friction.

17. A filament or yarn according to claim 16, wherein the first fiber consists essentially of polyethylenes, and said second fibers have a roughened surface.

18. An article produced from a filament or yarn comprising a first fiber consisting essentially at least one of a polyolefin and polyvinyl alcohol core spun or twisted with a second fiber having a higher coefficient of friction than said first fiber, wherein said first fiber has a higher tensile strength and a higher modulus than said second fiber and, wherein the proportion of said second fiber is a minor amount by weight and, wherein the article is substantially bulletproof.

19. An article according to claim 18, wherein the fibers having a high coefficient of friction have a roughened surface.

20. An article according to claim 17, wherein said roughening was effected by chemical or mechanical roughening or a combination thereof.

21. A filament or yarn according to claim 19, wherein said roughening was effected by corona treatment.

22. An article according to claim 18, wherein at least a portion of the filaments or yarns have been subjected to corona treatment.

* * * * *